United States Patent [19]

Futsuhara

[11] Patent Number: 4,649,837

[45] Date of Patent: Mar. 17, 1987

[54] AUTOMATIC SEWING MACHINE

[75] Inventor: Yoshio Futsuhara, Tokyo, Japan

[73] Assignee: Tokyo Juki Industrial Co., Ltd., Chofu, Japan

[21] Appl. No.: 629,716

[22] Filed: Jul. 11, 1984

[30] Foreign Application Priority Data

Jul. 19, 1983 [JP] Japan ..... 58-131644

[51] Int. Cl.[4] ..... D05B 21/00

[52] U.S. Cl. ..... 112/121.12

[58] Field of Search ..... 112/121.12, 121.11, 112/158 E, 121.15, 2

[56] References Cited

U.S. PATENT DOCUMENTS

| | | | |
|---|---|---|---|
| 3,742,879 | 7/1973 | Schaefer, Jr. et al. | 112/121.12 |
| 3,982,491 | 9/1976 | Herzer et al. | 112/121.12 |
| 4,050,393 | 9/1977 | Welcher et al. | 112/121.12 |
| 4,109,597 | 8/1978 | Adams | 112/158 E |
| 4,290,375 | 9/1981 | Tonomura et al. | 112/121.12 |
| 4,336,761 | 6/1982 | Magnan | 112/121.12 |
| 4,385,573 | 5/1983 | Brienza et al. | 112/158 E |

*Primary Examiner*—Peter Nerbun

*Attorney, Agent, or Firm*—Tarolli, Sundheim & Covell

[57] ABSTRACT

A workpiece holding member is movably supported by a stationary member secured to the bed of a sewing machine for moving in both the longitudinal and transverse direction and a movable member is connected to the holding member to be linearly and rotatably driven in the longitudinal and transverse directions by pulse motors.

10 Claims, 7 Drawing Figures

AUTOMATIC SEWING MACHINE

BACKGROUND OF THE INVENTION

This invention relates to an automatic sewing machine and more particularly, to an automatic sewing machine of the type in which a seam consisting of a predetermined number of stitches is formed as a holding member holding a workpiece thereon moves horizontally to and away from a needle drop position and which ceases to operation at the completion of the seam formation.

As automatic sewing machines, cycle sewing machines such as tacking, button hole darning and embroidering sewing machines have been known. As one of such automatic sewing machines, of late, an electrically controlled sewing machine has been proposed. In the electrically controlled sewing machine, the workpiece holding member is operatively connected to a pair of pulse motors for driving the holding member in X and Y directions, respectively and a seam in a predetermined pattern is formed by moving the holding member in the X and Y directions under the control of the pulse motors. However, in the prior art electrically controlled sewing machine, connection means such as a timing belt and a chain connect between the pulse motors and workpiece holding member and as a result, the electrically controlled sewing machine is inevitably complicate in construction and troublesome in assembling. In addition, because of increase in the number of components due to the provision of the connection means between the pulse motors and workpiece holding member, the step positions of the pulse motors and the displaced positions of the workpiece holding member tend to deviate from their predetermined or proper relationship resulting in incorrect needle drop position. The incorrect needle drop position leads to formation of unshapely seams in tacking and embroidering sewing machines and needle drop at an area to be cut and subsequent thread cutting by a knife in button hole darning sewing machines whereby the obtained sewn products are of inferior quality.

SUMMARY OF THE INVENTION

Thus, the present invention is to eliminate the drawbacks inherent in the prior art sewing machines referred to hereinabove.

The above and other objects and attendant advantages of the present invention will be more readily apparent to those skilled in the art from a reading of the following detailed description in conjunction with the accompanying drawings which show preferred embodiments of the invention for illustration purpose only, but not limiting the scope of the same in any way.

DETAILED EXPLANATION OF THE PREFERRED EMBODIMENTS

Figure 1:
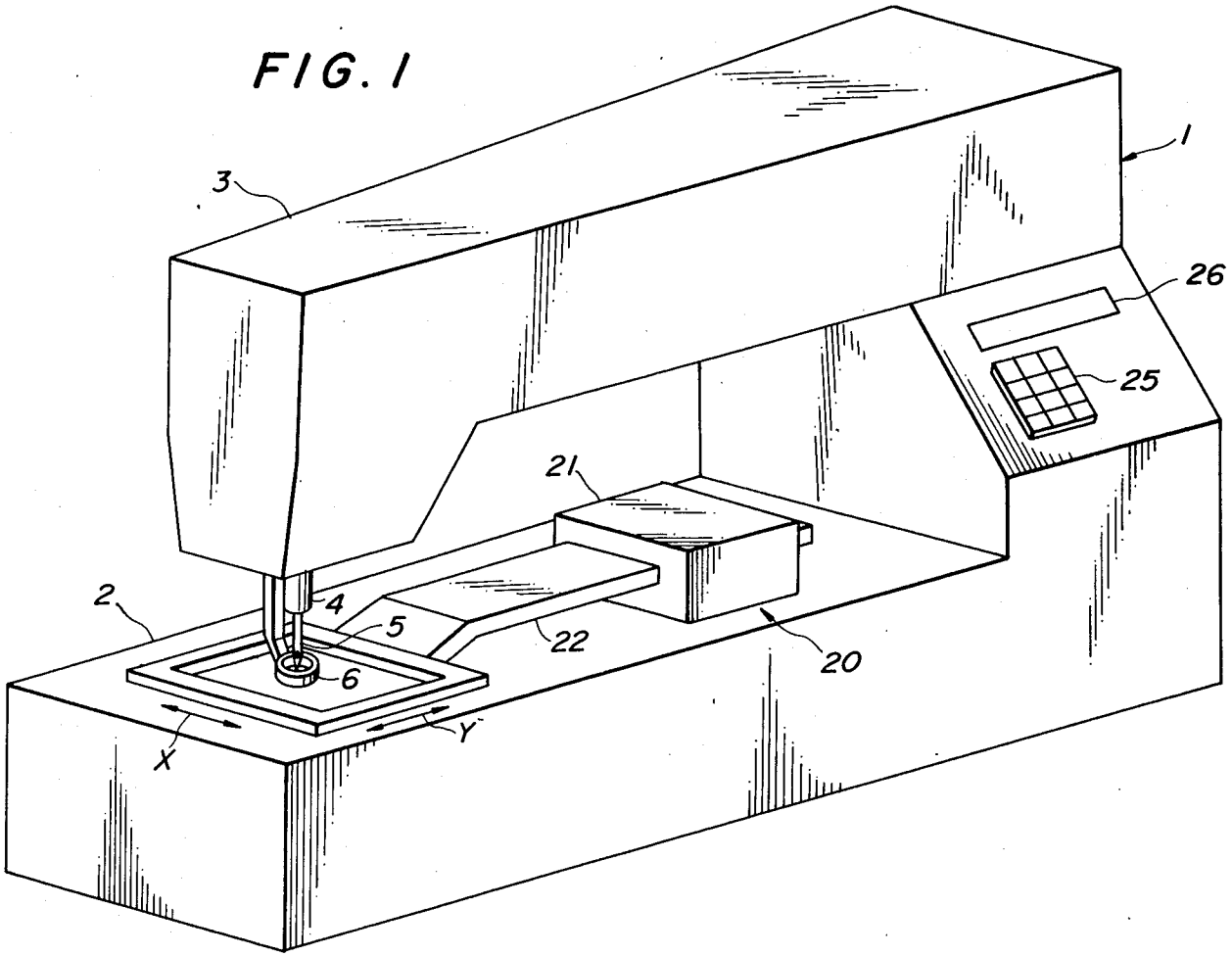
FIG. 1 is a perspective view of a first embodiment of the tacking sewing machine according to the present invention.

The present invention will be now described referring to the accompanying drawings. In the drawings, 1 denotes the body of the tacking sewing machine, 2 denotes the bed of the machine, 3 denotes the arm disposed above the bed 2 in parallel to the latter, 4 denotes the needle bar supported at the leading end of the arm 3 for vertical movement in response to the rotation of the sewing machine main shaft (not shown), 5 denotes the needle secured to the lower end of the needle bar 4 for cooperating with the bobbin mechanism (not shown) below the bed 2 and 6 denotes the pressure foot supported on the framework of the arm 3 for vertical movement and normally resiliently urged downwardly so as to contact the upper surface of the bed 2 adjacent to a needle drop position.

Within the bed 2, 7 denotes a support shaft secured to the machine framework and having the horizontal axis extending in a direction at an angle to the longitudinal axis of the bed 2; 8 denotes a holding plate supported at one end on the support shaft 7 for rotation about the axis of the shaft; 9 denotes a support pedestal of substantially U-shaped cross section having a pair of upright legs **9*a*, 9*b* in opposing relationship in the longitudinal direction of the bed 2; 10 denotes a pulse motor or a stepping motor disposed in upright position within the support pedestal 9; 11 denotes the drive shaft of the stepping motor 10, 12 denotes a main gear mounted on a drive shaft 11; 13 denotes a support shaft secured to and projecting upwardly from the upper end of the leg 9*a* of the support pedestal 9 and having the vertical axis; 14 denotes a follower gear rotatably supported on the support shaft 13 and having a first or lower gear portion 14*a* having the diameter larger than that of the main gear 12 and in meshing with the latter and a second or upper gear portion 14*b* having the diameter larger than that of the main gear 12 but smaller than that of the first gear portion 14*a*. 15 denotes a support shaft secured to and projecting upwardly from the leg 9*b* of the support pedestal 9 and having the vertical axis; 16 denotes an operation plate rotatably supported at the base on the support shaft 15 for rotation about the axis of the shaft 15 in opposition to the opening 2*a* in the top of the bed 2; 17 denotes a projection extending downwardly from the operation plate 16 covering a sector in a circle which has the center corresponding to the axis of the shaft 15 and having on the inner surface thereof teeth 17*a* in meshing with the second gear portion 14*b* of the follower gear 14 and 18; 19 denotes a pair of upholding posts projecting upwardly from the upper surface of the operation plate 16**.

Figure 4:
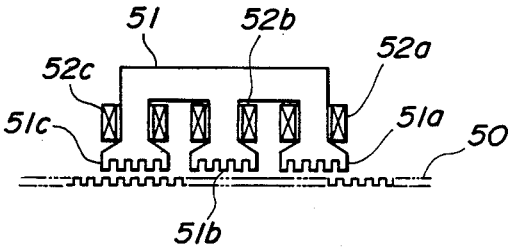
FIG. 4 is an explanative view showing the basic structure of the linear pulse motor employed in the sewing machine of the invention.

20 denotes a linear pulse motor comprising a stationary member 21 secured to the upper ends of the posts 18, 19 and a movable member 22 supported by the stationary member 21 for linear movement relative to the member 21 in the longitudinal direction of the bed 2 and as shown more clearly shown in FIG. 4, the linear pulse motor has such a basic construction in which the movable member 22 includes a movable element 50 formed of magnetic soft material and provided on the upper and lower surfaces with comb teeth of equal pitch and the stationary member 21 includes a stator 51 formed with three yokes 51*a*, 51*b*, 51*c* on the upper surface and the same number of 51*a*, 51*b*, 51*c* on the lower surface in symmetrical relationship to those on the upper surface, respectively (only those on the upper surface are shown), that is, the yokes on the upper and lower surfaces of the stator 51 oppose to the upper and lower surfaces of the movable element 50, respectively. The free end faces of the yokes 51*a*, 51*b*, 51*c* are formed with comb teeth which oppose to the comb teeth on the movable element 50, respectively. Coils 52*a*, 52*b*, 52*c* are wound about the yokes 51*a*, 51*b*, 51*c*, respectively. The linear pulse motor 20 and the stepping motor 10 are each provided with detection means (not shown) for detecting the operative positions of the motors.

The movable member 22 is formed at the leading end with a frame-like workpiece holding-down portion 23 (holding member) opposing to a needle drop position and the workpiece holding-down portion is adapted to move horizontally with a workpiece (not shown) pinched between the portion and the bed 2 as the movable member 22 moves.

Figure 2:
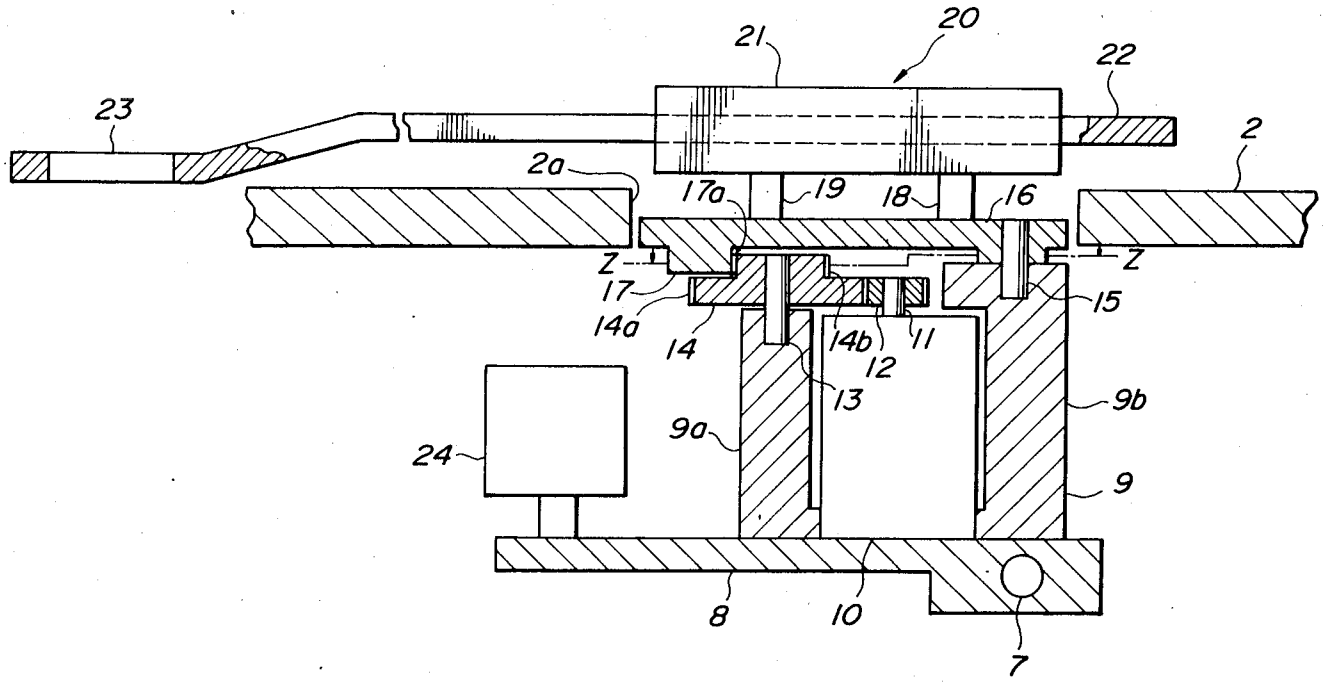
FIG. 2 is a fragmentary side elevational view in partial section on an enlarged scale of said sewing machine as shown in FIG. 1.
Figure 3:
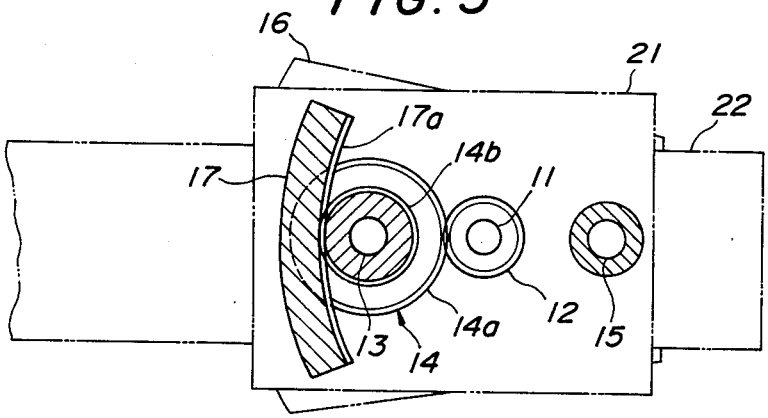
FIG. 3 is a plan view taken along the line Z—Z of FIG. 2.

24 denotes an electromagnet secured to the machine framework opposing to the upper surface of the leading end portion of the holding plate 8. The holding plate 8 is normally resiliently urged in the clockwise direction as seen in FIG. 2 or in the direction in which the holding-down portion 23 is urged away from the upper surface of the bed 2. When the electromagnet 24 is energized, the electromagnet causes the holding plate 8 to rotate in the counterclockwise direction (as seen in FIG. 2) against the resilient force acting on the plate to thereby urge the holding-down portion 23 against the upper surface of the bed 2. 25 denotes a plurality of manually operable switches adapted to set sewing pattern, number of stitches, sewing pitch and so on and 26 denotes an indication means adapted to indicate the information set for the switches 25.

Although not shown, disposed on the main shaft of the sewing machine are a needle position sensing means adapted to produce a signal at a predetermined angle of rotation during one complete rotation of the main shaft, a rotational position detection means adapted to sense a particular step position of the stepping motor 10 and a displaced position detection means adapted to detect a particular step position of the linear pulse motor 20.

Figure 5:
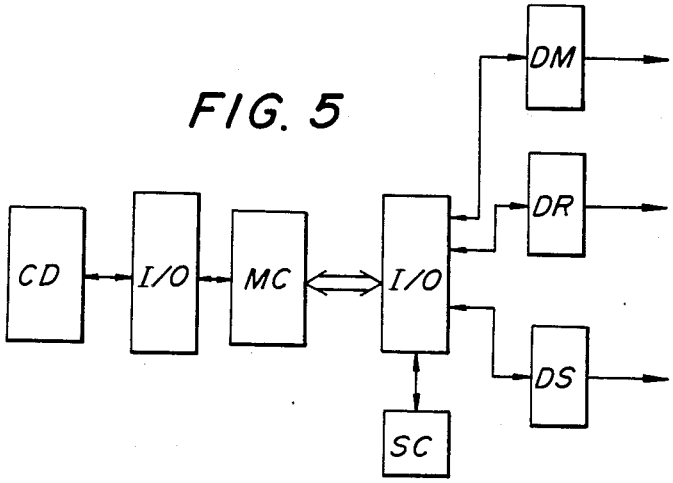
FIG. 5 is a block diagram of the circuit for the sewing machine of the invention.

The electrical circuit arrangement for the sewing machine will be now described referring to FIG. 5.

CD denotes an operation setting circuit having an input section to which setting data relating to the operation of the manual switches 25 are input and an indication means for indicating contents of inputs, SC denotes a detection circuit including the above-mentioned three direction means, DS denotes a drive circuit for producing step pulses for driving the stepping motor 10 in coils at various phases, DR denotes a drive circuit for producing step pulses for driving the linear pulse motor 20 in coils 52*a*–52*c* at various phases, and DM denotes an operation circuit for energizing and deenergizing the electromagnet 24.

Figure 6:
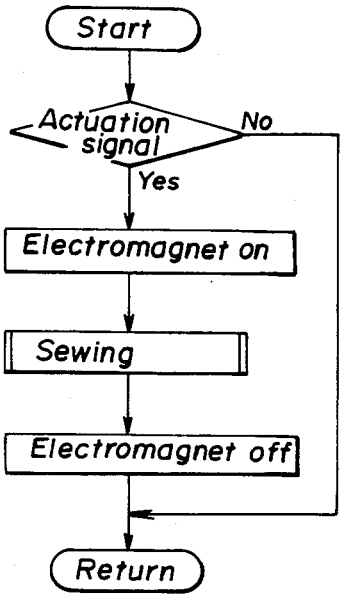
FIG. 6 is the main flow chart contained in the microcomputer for the sewing machine.

MC denotes a microcomputer (which will be abridged as "MICOM" hereinafter) connected to various circuits via an input and output circuit I/O and the MICOM drives the sewing machine in accordance with the main flow chart shown in FIG. 6 to form a predetermined shaped seam line based on the set information given from the operation setting circuit CD.

That is, when an actuation signal is produced in response to the operation of a pedal or the like, the operation circuit DM operates to energize the electromagnet 24 and a predetermined shaped seam line is then formed in accordance with the "sewing routine". Thereafter, the operation circuit DM operates to deenergize the electromagnet 24. Based on the set information from the operation setting circuit CD, the "sewing routine" sets data relating to number of stitches, sewing pitch, feed direction and so on required for a predetermined seam line, interrupt the operation of the sewing machine based on the data and controls the drive circuits DR, DS so that the drive circuits set the number of step pulses to the stepping and linear pulse motors 10, 20, respectively, so as to move the holding-down portion 23 to a needle drop position in response to a signal from the needle position detection means.

With the above-mentioned construction and arrangement of the components of the sewing machine of the invention, the holding plate 8 is normally resiliently biased in the clockwise direction as seen in FIG. 1 to urge the workpiece holding-down portion 23 upwardly away from the upper surface of the bed 2 and predetermined sewing pattern, number of stitches and sewing pitch are set in response to the operation of the manual switches 25.

When an actuation signal is produced in response to the operation of the pedal, the electromagnet 24 is energized by a signal from the operation circuit DM to cause the holding plate 8 to rotate in the counterclockwise direction (as seen in FIG. 2) against the resilient force applied to the holding plate 8 which in turn urges the workpiece holding-down portion 23 against the upper surface of the bed 2 with the workpiece pinched therebetween and the "sewing routine" is then followed.

The sewing machine 1 is driven to rotate the main shaft, the needle bar 4 is moved downwardly and upwardly and the needle 5 moves downwardly and upwardly as the needle bar 4 moves upwardly and downwardly to form a seam line on the workpiece in cooperation with the bobbin mechanism. Each time the main shaft has completed one revolution, the needle position detection means produces a needle position signal and the MYCOM reads data in succession and the drive circuits DS, DR produce a predetermined number of step pulses so as to move the workpiece holding-down portion 23 to the next needle drop position based on the data. When the stepping motor 10 is actuated for step drive, the rotation of the main gear 12 is transmitted to the follower gear 14 through the first gear portion 14*a* of the follower gear 14 which meshes the main gear 12 and the rotation of the follower gear 14 is transmitted to the operation plate 16 through the teeth 17*a* on the arcuate projection 17 which meshes the second gear portion 14*b* of the follower gear 14 whereby the operation plate 16 rotates about the axis of the support shaft 15 by a predetermined angular distance corresponding to a step angle so as to move the workpiece holding-down portion 23 in the X direction as shown in FIG. 1. When the linear pulse motor 20 is actuated for step drive, the movable member 22 moves right and left and vice versa as seen in FIG. 2 to thereby move the workpiece holding-down portion 23 in the Y direction as seen in FIG. 1. The movements in both the X and Y directions bring the holding-down portion to the next needle drop position. By repeating the movement of the workpiece holding-down portion in the X and Y directions, a predetermined number of seam lines are formed whereupon the "sewing routine" completes. Upon the completion of the "sewing routine", the operation circuit products a signal to deenergize the electromagnet 24 whereby the holding plate 8 rotates in the clockwise direction under the resilience acting on the plate which in turn urges the workpiece holding-down portion 23 upwardly away from the upper surface of the bed 2 to thereby release the workpiece.

In the embodiment described hereinabove, although the workpiece holding-down portion 23 is shown as being integrally formed with the leading end of the movable member 22 associated with the linear pulse motor 20, the portion 23 may be made as a separate part and attached to the leading end of the movable member 22.

And although the main gear 12 on the drive shaft 11 associated with the stepping motor 10 is shown as being operatively connected to the teeth 17*a* on the projection 17 through the follower gear 14, the main gear 12 may directly engage with the teeth 17*a*.

Figure 7:
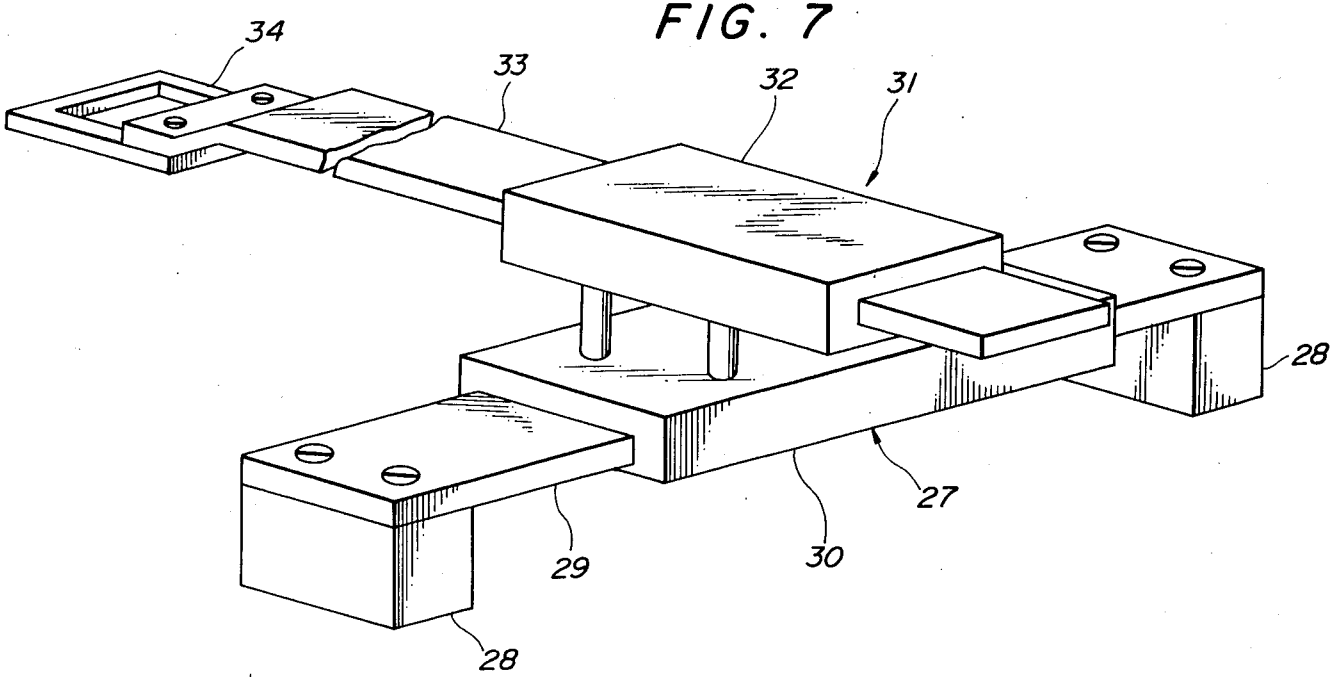
FIG. 7 is a perspective view of another embodiment of the sewing machine of the invention.

In place of the embodiment described hereinabove, the present invention may be embodied as shown in FIG. 7 in which the workpiece holding-down portion is moved by two linear pulse motors. In the embodiment of FIG. 7, in association with one of the two linear pulse motors 27, a stationary member 29 similar to the movable member 22 in the above-mentioned embodiment is secured to a support pedestal 28 on the holding plate 8 in the foregoing embodiment and a movable member 30 similar to the stationary member 21 in the foregoing embodiment is movably supported on the stationary member 29 for horizontal movement in the longitudinal direction (the X direction as seen in FIG. 1) and a second linear pulse motor 31 (an assembly of stationary and movable members 32, 33) similar to the linear pulse motor 20 in the foregoing embodiment is secured to the upper surface of the movable member 30.

The two linear pulse motors 27, 31 are supplied step pulses thereto to cause the workpiece holding-down member 34 at the leading end of the movable member 33 to move in both the X and Y directions.

In the foregoing, although the present invention has been described in connection with the tacking sewing machine, the invention is equally embodied as embroidering, button hole darning and button attaching sewing machines.

As mentioned hereinabove, according to the present invention, the holding member for movement to and away from the needle drop position, the linear pulse motor to allow the movable member connected to the holding member to move linearly in a horizontal direction along the main shaft disposed above the sewing machine bed, the pulse motor for allowing the movable member connected the linear pulse motor for movement in a horizontal direction across the longitudinal axis of the main shaft to move linearly or rotate are provided whereby the timing belt and chain provided in the conventional sewing machines can be eliminated resulting in simplification of construction and easy assembling of the components. In addition, since the number of connection components between the holding member and motors can be reduced, the motors can rotate stepwise without causing error between step positions of the motors and thus, fine sewing patterns can be obtained and sewn thread will not be damaged to thereby substantially improve the quality of sewn products.

While the present invention has been described in connection with particular embodiments thereof, it will be understood by those skilled in the art that many changes and modifications may be made without departing from the true spirit and scope of the present invention. Therefore, it is intended by the appended claim to occur all such changes and modifications which come within the true spirit and scope of this invention.

What is claimed is:

1. An automatic sewing machine comprising:

a workpiece holding member movable along the upper surface of the bed of said sewing machine toward and away from a needle drop position;

first motor means connected with said workpiece holding member for moving said workpiece holding member along a first axis;

second motor means connected with said first motor means for moving said first motor means and said workpiece holding member along a second axis extending perpendicular to said first axis;

control means for controlling the operation of said first and second motor means to move said workpiece holding member to predetermined positions relative to the bed of said sewing machine during operation of said sewing machine;

a movable support member, said workpiece holding member, first motor means and second motor means being supported by said movable support member; and means for moving said movable support member toward and away from the bed of said sewing machine to move said workpiece holding member toward and away from the bed of said sewing machine.

2. A sewing machine as set forth in claim 1 wherein:

said first motor means is a linear pulse motor having an armature connected with said workpiece support member and a stator; and said second motor means being operable to move said stator and armature of said first motor means relative to the bed of said sewing machine.

3. A sewing machine as set forth in claim 1 wherein:

said second motor means includes a rotary armature and a stator; and said sewing machine further including gear means for transmitting drive forces from said second motor means to said first motor means to move said first motor means and workpiece holding member relative to the bed of said sewing machine.

4. A sewing machine as set forth in claim 1 wherein said first motor means is disposed above the upper surface of the bed of said sewing machine and said second motor means is disposed beneath the upper surface of the bed of said sewing machine.

5. An automatic sewing machine comprising:

a workpiece holding member movable along the upper surface of the bed of said sewing machine toward and away from a needle drop position;

first motor means connected with said workpiece holding member for moving said workpiece holding member along a first axis, said first motor means being disposed above the upper surface of the bed of said sewing machine;

second motor means connected with said first motor means for moving said first motor means and said workpiece holding member along a second axis extending perpendicular to said first axis, said second motor means being disposed beneath the upper surface of the bed of said sewing machine; and control means for controlling the operation of said first and second motor means to move said workpiece holding member to predetermined positions relative to the bed of said sewing machine during operation of said sewing machine.

6. A sewing machine as set forth in claim 5 wherein said second motor means is a linear pulse motor.

7. A sewing machine as set forth in claim 5 wherein:

said first motor means is a linear pulse motor having an armature connected with said workpiece support member and a stator; and said second motor means being operable to move said stator and armature of said first motor means relative to the bed of said sewing machine.

8. A sewing machine as set forth in claim 7 wherein:

said second motor means includes a rotary armature and a stator; and said sewing machine further including gear means for transmitting drive forces from second motor means to said first motor means to move said first motor means and workpiece holding member relative to the bed of said sewing machine.

9. An automatic sewing machine comprising:

a workpiece holding member movable along the upper surface of the bed of said sewing machine toward and away from a needle drop position;

a first linear pulse motor disposed above the bed of said sewing machine for linearly moving a movable member connected to said holding member in a horizontal direction along the main shaft of said machine;

a second linear pulse motor disposed below said machine bed for linearly moving said movable member in a horizontal direction across said main shaft; and a control circuit for producing step pulses in a predetermined number in each of said motors so as to move said movable member to a predetermined position relative to said needle drop position each time said main shaft rotates one complete revolution.

10. An automatic sewing machine comprising:

a workpiece holding member movable along the upper surface of the bed of said sewing machine toward and away from a needle drop position;

a linear pulse motor disposed above the bed of said sewing machine for linearly moving a movable member connected to said holding member in a horizontal direction along the main shaft on said machine;

a pulse motor disposed below said machine bed for rotatably moving said movable member in a horizontal direction across said main shaft; and a control circuit for producing step pulses in a predetermined number in each of said motors so as to move said movable member to a predetermined position relative to said needle drop position each time said main shaft rotates one complete revolution.

* * * * *